US010315172B2

(12) United States Patent
Kozyuk

(10) Patent No.: US 10,315,172 B2
(45) **Date of Patent: *Jun. 11, 2019**

(54) ROTOR AND STATOR DEVICE HAVING BORE HOLES FOR CAVITATIONAL MIXING

(71) Applicant: Arisdyne Systems, Inc., Cleveland, OH (US)

(72) Inventor: Oleg Kozyuk, North Ridgeville, OH (US)

(73) Assignee: ARISDYNE SYSTEMS, INC., Cleveland, OH (US)

( * ) Notice: Subject to any disclaimer, the term of this patent is extended or adjusted under 35 U.S.C. 154(b) by 430 days.

This patent is subject to a terminal disclaimer.

(21) Appl. No.: 14/976,048

(22) Filed: Dec. 21, 2015

(65) Prior Publication Data

US 2016/0175791 A1 Jun. 23, 2016

Related U.S. Application Data

(60) Provisional application No. 62/095,489, filed on Dec. 22, 2014.

(51) Int. Cl.
*B01F 7/00* (2006.01)

(52) U.S. Cl.
CPC ..... *B01F 7/00816* (2013.01); *B01F 7/008* (2013.01); *B01F 2215/0431* (2013.01)

(58) Field of Classification Search
CPC .... B01F 7/0075; B01F 7/008; B01F 7/00808; B01F 7/00816; B01F 7/00833; B01F 7/00358; B01F 2215/0431
(Continued)

(56) References Cited

U.S. PATENT DOCUMENTS 3,194,540 A * 7/1965 Hager ..... A01J 11/16 241/259.1
4,564,333 A 1/1986 Timby et al.
(Continued)

FOREIGN PATENT DOCUMENTS

DE 1047176 B 12/1958
DE 102006006161 A1 8/2007
(Continued)

OTHER PUBLICATIONS

International Search Report and Written Opinion issued in corresponding International Patent Application No. PCT/US2015/066993; dated Apr. 12, 2016.
(Continued)

*Primary Examiner* — Charles Cooley
(74) *Attorney, Agent, or Firm* — Pearne & Gordon LLP

(57) ABSTRACT

A device for generating controlled formation and collapse of cavitation bubbles in a fluid. The device includes a rotor having a plurality of bore holes and a stator having a plurality of bore holes. Fluid flows into the device and passes through a space between the stator and rotor to expose the fluid to the bore holes of each component. The rotor can be rotated relative to the stator to pass the rotor bore holes across the openings of the stator bore holes to generate and collapse cavitation bubbles in the stator bore holes. The rotor bore holes may have the same diameter as the stator bore holes and the rotor bore holes preferably have depth equal to or less than the depth of the stator bore holes.

14 Claims, 2 Drawing Sheets

(58) Field of Classification Search
USPC ..... 366/264, 302, 304, 305
See application file for complete search history.

(56) References Cited

U.S. PATENT DOCUMENTS

| | | | | |
|---|---|---|---|---|
| 5,188,090 | A | 2/1993 | Griggs | |
| 5,385,298 | A | 1/1995 | Griggs | |
| 5,622,650 | A | 4/1997 | Rourke | |
| 5,957,122 | A | 9/1999 | Griggs | |
| 6,627,784 | B2 | 9/2003 | Hudson et al. | |
| 6,857,774 | B2 * | 2/2005 | Kozyuk | B01F 3/0807 366/263 |
| 7,178,975 | B2 * | 2/2007 | Kozyuk | B01F 5/0057 366/165.4 |
| 7,316,501 | B2 * | 1/2008 | Thoma | B01F 3/04531 366/168.1 |
| 7,318,553 | B2 * | 1/2008 | Thoma | F22B 3/06 123/142.5 R |
| 7,357,566 | B2 * | 4/2008 | Kozyuk | B01F 5/0057 366/165.4 |
| 7,387,262 | B2 * | 6/2008 | Thoma | F24J 3/003 123/142.5 R |
| 7,507,014 | B1 * | 3/2009 | League | B01F 7/00816 366/172.1 |
| 7,771,582 | B2 | 8/2010 | Kazem | |
| 8,449,172 | B2 | 5/2013 | Wood et al. | |
| 9,776,159 | B2 * | 10/2017 | Kozyuk | B01J 19/008 |
| 10,065,167 | B2 * | 9/2018 | Kozyuk | B01F 7/00816 |
| 10,173,191 | B2 * | 1/2019 | Parker | B01J 8/16 |
| 2003/0147302 | A1 * | 8/2003 | Uesugi | B01F 3/0807 366/164.6 |
| 2004/0022122 | A1 * | 2/2004 | Kozyuk | B01F 3/0807 366/262 |
| 2005/0150618 | A1 * | 7/2005 | Kazem | B01F 7/00816 162/50 |
| 2005/0237855 | A1 * | 10/2005 | Kozyuk | B01F 5/0057 366/304 |
| 2011/0075507 | A1 | 3/2011 | Wootan et al. | |
| 2015/0367313 | A1 | 12/2015 | Kozyuk | |
| 2016/0175791 | A1 * | 6/2016 | Kozyuk | B01F 7/00816 366/118 |
| 2016/0312099 | A1 * | 10/2016 | Armstead | B01J 8/10 |
| 2016/0325255 | A1 * | 11/2016 | Parker | B01J 8/16 |
| 2017/0007976 | A1 * | 1/2017 | Kozyuk | B01J 19/008 |
| 2017/0028375 | A1 * | 2/2017 | Kozyuk | B01J 19/008 |

FOREIGN PATENT DOCUMENTS

| | | | |
|---|---|---|---|
| SU | 1537546 A1 * | 1/1990 | B01F 7/00191 |
| WO | WO2005021050 | 3/2005 | |
| WO | WO2012089474 | 7/2012 | |

OTHER PUBLICATIONS

Supplementary European Search Report issued in corresponding European Patent Application No. 15874224.7; dated Jul. 24, 2018.

* cited by examiner

ROTOR AND STATOR DEVICE HAVING BORE HOLES FOR CAVITATIONAL MIXING

This application claims the benefit of U.S. provisional application Ser. No. 62/095,489 filed Dec. 22, 2014, the contents of which are incorporated herein in their entirety by reference.

FIELD

The present disclosure relates to a cavitational mixing device, and more particularly, a device for mixing fluids under controlled formation and collapse of cavitation bubbles in a fluid passing through the device.

BACKGROUND

In the field of cavitation mixing, various devices using rotors or other rotating members to generate hydrodynamic cavitation are known. Typical of the art are those devices disclosed in the following U.S. Pat. Nos. 5,188,090; 5,385,298; 5,957,122; 6,627,784; 6,857,774; 7,318,553; 7,357,566; 7,771,582 and 8,449,172. The devices disclosed in the aforementioned patents are useful for mixing dissimilar fluids.

To more efficiently mix fluids in rotor/stator type devices, the energy released from the cavitation bubbles generated in the bore openings and gap between the rotor and the stator can be enhanced. For this purpose, the cavitation generation flow path in which cavitation bubbles exist can be collapsed under high pressure. Accordingly, there is a need to improve cavitational mixing devices that result in poor efficiency and low energy release within the cavitational field.

SUMMARY

In a first aspect, there is a device for cavitational mixing, the device includes a housing having a chamber defined by a cylindrical wall having a longitudinal axis, the chamber further partially defined by a pair of end walls; a stator forming a portion of an end wall, the stator including a circumferential external surface facing the cylindrical wall and a first plurality of stator bore holes oriented perpendicular to the housing longitudinal axis; and a rotor mounted on a shaft, the rotor positioned within the housing chamber, the rotor including a circumferential internal surface facing the circumferential external surface of the stator, the circumferential internal surface of the rotor having a second plurality of rotor bore holes oriented perpendicular to the housing longitudinal axis, wherein the stator and the rotor are positioned such that the first plurality of stator bore holes are substantially in register to the second plurality of rotor bore holes, and when the rotor is rotated relative to the stator each of the second plurality of rotor bore holes passes a stator bore hole of the first plurality of stator bore holes, and wherein each of the bore holes in the second plurality of rotor bore holes and each of the bore holes in the first plurality of stator bore holes has substantially the same diameter.

In an example of aspect 1, the housing further including at least one inlet port for introducing fluid into a space between the circumferential internal surface of the rotor and the circumferential external surface of the stator.

In another example of aspect 1, the inlet port for introducing fluid is positioned in line with the center of the stator.

In another example of aspect 1, the housing further includes at least one outlet port for discharging fluid mixed in the device.

In another example of aspect 1, the rotor bore holes and the stator bore holes have a cylindrical shape.

In another example of aspect 1, the shaft is connected to a motive means to rotate the rotor.

In another example of aspect 1, the ratio of the depth of the stator bore holes to the depth of the rotor bore holes is less than 10:1.

In another example of aspect 1, the ratio of the depth of the stator bore holes to the depth of the rotor bore holes is greater than 1:1.

In another example of aspect 1, the stator includes two or more pluralities of stator bore holes, each plurality of the two or more plurality of stator bore holes includes bore holes arranged in a straight-line series and each stator bore hole of each plurality is equally spaced apart from one another; the rotor includes two or more pluralities of rotor bore holes, each plurality of the two or more pluralities of rotor bore holes includes bore holes arranged in a straight-line series and each rotor bore hole of each plurality is equally spaced apart from one another; the distance between each stator bore hole of each plurality or each rotor bore hole of each plurality is greater than the diameter of the stator bore holes and/or rotor bore holes.

In another example of aspect 1, the stator includes two or more pluralities of stator bore holes, each plurality of stator bore holes includes two or more stator bore holes.

In another example of aspect 1, the rotor includes two or more pluralities of rotor bore holes, each plurality of rotor bore holes includes two or more rotor bore holes.

In another example of aspect 1, the first plurality of stator bore holes has stator bore hole openings on the circumferential external surface of the stator and the second plurality of rotor bore holes has rotor bore hole openings on the circumferential internal surface of the rotor, the stator bore hole openings are spaced apart from the rotor bore hole openings at least 0.1 mm.

In another example of aspect 1, the stator bore holes of the first plurality have a cylindrical shape of constant diameter, the stator bore holes have an opening along the circumferential external surface of the stator and a flat closed end positioned within the stator.

In another example of aspect 1, the rotor bore holes of the second plurality have a cylindrical shape of constant diameter, the rotor bore holes have an opening along the circumferential internal surface of the rotor and a flat closed end positioned within the rotor.

In another example of aspect 1, the chamber has no more than two openings for introducing and discharging fluid through the housing for allowing the fluid to pass over the first plurality of the stator bore holes and the second plurality of the rotor bore holes.

The first aspect may be provided alone or in combination with any one or more of the examples of the first aspect discussed above.

The accompanying drawings are included to provide a further understanding of principles of the invention, and are incorporated in and constitute a part of this specification. The drawings illustrate one or more embodiment(s), and together with the description serve to explain, by way of example, principles and operation of the invention. It is to be understood that various features disclosed in this specification and in the drawings can be used in any and all combinations. By way of non-limiting example the various features may be combined with one another as set forth in the specification as aspects.

DETAILED DESCRIPTION

Herein, when a range such as 5-25 (or 5 to 25) is given, this means preferably at least 5 and, separately and independently, preferably not more than 25. In an example, such a range defines independently not less than 5, and separately and independently, not less than 25.

A device has been developed for providing an efficient, high-energy way to mix fluids by generating cavitation within the device. The device allows for the controlled formation and collapse of cavitation bubbles in a fluid, for example, in one or more bore holes within the device.

Figure 1:
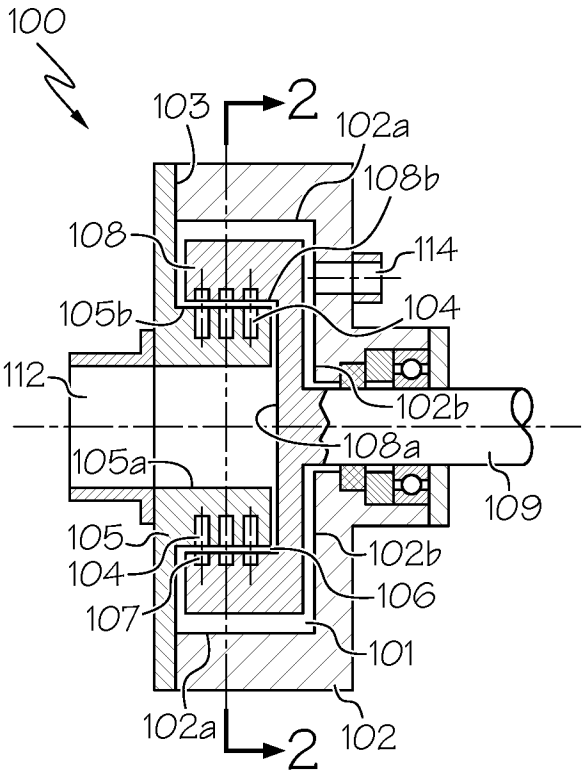
FIG. 1 shows a longitudinal cross-sectional view of a cavitational mixing device.

In one embodiment, FIG. 1 shows a cross-section of a device for cavitational mixing of a fluid or mixture of more than one fluid. As shown, the device 100 has a longitudinal axis denoted by the broken line running central to the inlet port 112 and shaft 109 of the rotor 108. As shown, the inlet port 112 is in line with the center of the stator 105 along the longitudinal axis.

The device 100 includes housing 102 that partially defines chamber 101. Housing 102 has an inner cylindrical or circumferential wall surface 102*a* parallel to and facing towards the longitudinal axis ("axis") of the device and an adjacent end wall surface 102*b* facing perpendicular to the longitudinal axis of the device. Surfaces 102*a* and 102*b* are adjacent and connected to or integral with one another. Preferably, housing 102 is an integral component such that surfaces 102*a* and 102*b* are made of the same material.

Opposing surface 102*b* at a distance is stator 105 that, in part, forms the other end wall surface chamber 101. A portion of stator 105 is perpendicular to the longitudinal axis of the device, which is also adjacent inner circumferential surface 102*a*. As shown, stator 105 is mounted as an end wall on housing 102 with section 103 of the stator 105 being in direct contact and connected to housing 102 to secure the stator thereto. The stator 105 has a flat circular portion with an outer diameter portion 103 being in contact with housing 102. The central portion of the circular portion of the stator has a protuberance section (shown in the shape of a ring) that extends inward into housing 102 and the chamber 101. The protuberance section of the stator may be a hollow cylinder having an outer circumferential surface 105*b* facing towards the inner cylindrical or circumferential wall surface 102*a* of housing 102 and further includes a central opening defined by an inner circumferential surface 105*a* for accommodating fluid flowing into the device through the stator 105.

The stator 105 has a plurality of stator bore holes 104, for example a first plurality, in the protuberance section extending into housing 102 and chamber 101. The plurality of bore holes 104 can be positioned in a series such as in a straight line as shown, in which there can be multiple groups of in-line series of bore holes equally spaced about outer circumferential surface 105*b* of the protuberance section. The stator bore holes 104 each have openings along outer or external circumferential surface 105*b* of stator 105. The bore holes 104 extend inward into the stator 105 body, shown as the protuberance section in FIG. 1. The bore holes 104 terminate within the stator protuberance section and have a closed end, for example a flat end, positioned in the stator body. That is, bore holes 104 do not extend through the protuberance section such that the external circumferential surface 105*b* of stator 105 is in fluid connection with the inner circumferential surface 105*a* by passage through bore holes 104.

The stator bore holes 104 can have any shape, for example, cylindrical or circular, and can have a uniform or substantially uniform cross section or diameter. In one example, the stator bore holes can have a diameter in the range of 5 to 60 mm, 10 to 40 mm or 15, 20, 25, 30 or 35 mm. The stator bore holes 104 can have any suitable depth, for example, the holes can have a depth in the range of 4 to 200 mm, 10 to 100 mm or 20, 40, 60 or 80 mm.

The central opening of stator 105 forms an inlet port 112, for example a space defined by the inner circumferential surface 105*a* of the protuberance of the stator 105, for introducing fluid or a mixture of fluids into chamber 101 of the device 100. The diameter of the inlet port 112 formed by the inner circumferential surface 105*a* can be in the range of 5 to 300 mm. As shown, inlet port 1112 can optionally be connected to a pipe, flange, fitting or the like to accommodate fluid flow into the device and connect the device to a fluid source (e.g., a supply pipe) for passing fluid into and through the device. Fluid can enter the device by any suitable means, for example, by use of a pump, and can be at pressure in the range of 1 to 2,000, 5 to 1,500, 20 to 1,000, 50 to 800 or 100, 200, 300, 400, 500, 600 or 700 psi. Fluid flows through the inlet port 112 of stator 105 and contacts a central face 108*a* of rotor 108, the surface of the face arranged perpendicular to the longitudinal axis, and continues into space 106 between the circumferential internal surface 108*b* of rotor 108 and the circumferential external surface 105*b* of stator 105. The fluid passes over bore hole openings in the stator and rotor, preferably as the rotor rotates at a revolution rate capable of producing cavitation in the fluid, for example, fluid retained in the bore holes (e.g. stator bore holes). The fluid can further pass into and out of individual bore holes in the stator and rotor during operation.

The cavitated fluid forms a cavitation zone within the chamber. The cavitation bubbles in the cavitation zone, for example, in the bore holes (e.g. 104) or space 106 which includes the chamber area between the inner circumferential surface 108*b* of rotor 108 and the outer circumferential surface 105*b* of the stator 105, are subsequently collapsed under pressure as the fluid is exposed to pressure generated by the rotation of the rotor or as it continues through chamber 101 and is discharged from the device 100, e.g., 114. The cavitation zone can begin in the bore hole and extend into space 106. Alternatively, the cavitation zone can extend downstream of space 106 as the fluid continues through chamber 101 and exits the device.

The device further includes rotor 108 that is positioned in chamber 101 formed in part by housing 102. Rotor 108 extends into chamber 101 on shaft 109 and rotor 108 forms a portion of an end wall to the chamber in that shaft 109 to which it is attached fills and seals the opening in face 102*b* of housing 102. Housing 102 fits around shaft 109 and conventional seal features for ensuring a fluid tight seal between shaft 109, housing 102 and chamber 101 can be used as known in the art. The portion of rotor 108 extending into chamber 101 includes a cylindrical body open at one end and closed along rotor face 108*a* that is oriented perpendicular to the longitudinal axis of the device. The cylindrical body of rotor 108 is positioned in the device 100 such that it has the protuberance section of stator 105 and outer circumferential surface 105*b* having bore hole 104 openings nested in the open end of the cylindrical body of rotor 108. As shown, the cylindrical body of rotor 108 has a circumferential internal surface 108*b* facing the circumferential external surface 105*b* of stator 105, or space 106.

The rotor 108 and shaft 109 can be connected to a motive means for rotating the rotor, for example, a motor. In an example, shaft 109 is connected to a motor for rotating rotor 108 at a desirable rate or rpm. The rotor 108 can be rotated at a rate in the range of 500 to 30,000 rpm, or at least 750, 1,000, 1,500, 2,000 or 2,500 rpm.

The circumferential internal surface 108*b* of rotor 108 can have a plurality of rotor bore holes 107, for example a second plurality. The plurality of bore holes 107 can be positioned in a series such as in a straight line as shown. There can be multiple series of rotor bore holes spaced along and equally away from one another on the inner circumferential surface 108*b* of rotor 108. The bore holes 107 extend inward from the circumferential internal surface 108*b* into the body of the rotor 108 as shown. The bore holes 107 terminate and have a closed end, for example a flat end, positioned in the rotor body. That is, the bore holes 107 do not extend through the rotor body such that the external circumferential surface or rotor 108 opposite surface 108*b* is in fluid connection with the inner circumferential surface 108*b* by passage through bore holes 107. The openings of bore holes 107 are inward facing towards surface 105*b* of the stator and the opening of stator bore holes 104.

The rotor bore holes 107 can have any shape, for example, cylindrical or circular, and can have a uniform or substantially uniform cross section or diameter. In one example, the rotor bore holes can have a diameter in the range of 5 to 60 mm, 10 to 40 mm or 15, 20, 25, 30 or 35 mm. The rotor bore holes 107 can have any suitable depth, for example, the holes can have a depth in the range of 2 to 150 mm, 10 to 100 mm or 20, 40, 60 or 80 mm.

In comparing the depth of the stator bore holes 104 to the depth of the rotor bore holes 107, the ratio of depth of the stator bore holes to the rotor bore holes can be in the range 10:1 to 1:1, or less than 10:1, less than 8:1, less than 5:1, less than 4:1, less than 3:1, less than 2:1 or less than 1.5:1. Preferably, the depth of the stator bore holes is greater than the depth of the rotor bore holes. The depth of the bore holes is measured from the surface adjacent the opening of the bore holes (e.g. 105*b*, 108*b*) to the point along the closed end of the bore hole furthest away from the opening of the bore hole.

In one or more embodiments, stator bore holes 104 and rotor bore holes 107 are positioned such that a first plurality of holes 104 may be in register with a second plurality of hole 107 at one or more positions in the device as rotor 108 rotates around or relative to stator 105. As rotor 108 rotates relative to stationary stator 105, the second plurality of holes 107 passes over or by the first plurality of holes 104 at pre-determined positions, and at a point in time, are in register with or mirror holes 104.

Figure 2:
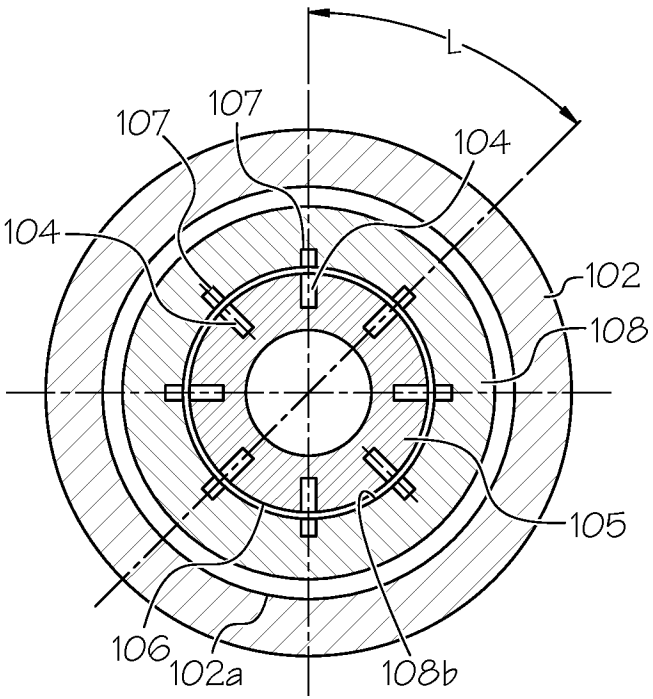
FIG. 2 shows a cross-sectional view of the cavitational mixing device shown in FIG. 1, along the plane defined by line 2-2 in FIG. 1.

As shown in FIG. 2, along plane 2-2 of FIG. 1, stator 105 and rotor 108 are assembled such that stator bore holes 104 are aligned and in register with rotor bore holes 107. As rotor 108 rotates relative to stator 105, the bore holes become unaligned and not in register with one another until rotor 108 rotates far enough to align and bore holes 107 and 104 again. This bore hole alignment process is continually repeated as the rotor 108 rotates relative to stator 105. The distance L between stator bore holes 104 is equal between each stator bore hole 104 and the distance L between rotor bore holes 107 is equal between each rotor bore hole 107 in the plurality of holes. The distance L between the stator bore holes 104 is less than the distance L between the rotor bore holes 107. The space 106 between the outer circumferential surface of stator 105 and inner circumferential surface of rotor 108 can be in the range of 0.1 to 20 mm, 0.5 to 15 mm, or 1, 3, 5, 8, 10 or 12 mm. The open space between the outer circumferential surface of the rotor 108 and the inner surface of the housing 102 can be in the range of 0.3 to 20 mm, 0.5 to 15 mm, or 1, 3, 5, 8, 10 or 12 mm.

In one or more embodiments, one or more stator bore holes 104 can have the same or substantially the same diameter as one or more rotor bore holes 107, for example, the first plurality of stator bore holes 104 can have the same or substantially the same diameter as the second plurality of rotor bore holes 107. In the case the stator and rotor have additional bore holes or plurality of bore holes, the additional bore holes of each component can have the same or substantially the same diameter. In another embodiment, one or more stator bore holes can have a larger diameter than one or more rotor bore holes, or alternatively, one or more stator bore holes can have a smaller diameter than one or more rotor bore holes.

Figure 3:
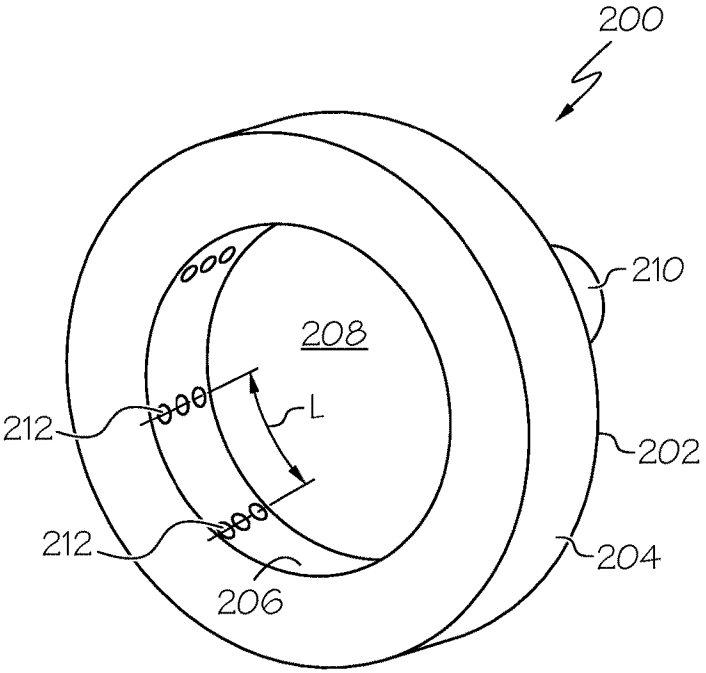
FIG. 3 shows a perspective view of a rotor for use in a cavitational mixing device.

In one or more embodiments, the rotor 108 can have two or more pluralities of rotor bore holes. Each plurality of rotor bore holes can have bore holes arranged a series or straight line. The plurality of bore holes can be spaced equally apart from one another on surface 108*b*. The distance between each plurality of rotor bore holes can be in the range of 30 to 250 mm, or at least 40, 50, 60, 80, 100, 150 or 200 mm. Each plurality can have two or more bore holes, for example, 3, 4 or 5 bore holes. In one example, FIG. 3 shows a rotor 200 having multiple pluralities 212 of rotor bore holes arranged on the inner circumferential surface 206 of rotor 200 for housing the protuberance section of the stator. Each plurality of bore holes on the rotor 200 as shown includes 3 rotor bore holes 212 (shown as cylindrical holes) arranged in a straight line and spaced equally from one another in a longitudinal direction along the axis of device. The rotor bore holes 212 face inward away from surface 204. It is appreciated that the rotor bore holes 212 can be different shapes than as shown.

The rotor 200 further include surface 208 that faces the protuberance section of the stator, wherein surface 208 on the surface opposite the stator area is connected to shaft 210 for rotating the rotor 200 relative to the stator during operation. Surface 208 or base portion has the raised rotor body in form of a circular disk or annular raised portion as illustrated and having an open section for accommodating a stator. The raised section can be in the shape of a ring having an inner circumference surface 206 and outer circumferential surface 204. The area bound by the inner circumferential surface and surface 208 is shown as an empty cylindrical spaced for accommodating fluid and a stator. As noted above, rotation of rotor 200 body is facilitated by shaft 210. The shaft is arranged to facilitate rotation of rotor 200 around an axis defined by a longitudinal line running along the length of shaft 210 through its center, for example, the center longitudinal line through the device and at the center of the inlet port to the device (not shown in FIG. 3). Such an axis can also be referred as an axis of rotation for rotor 200.

Figure 4:
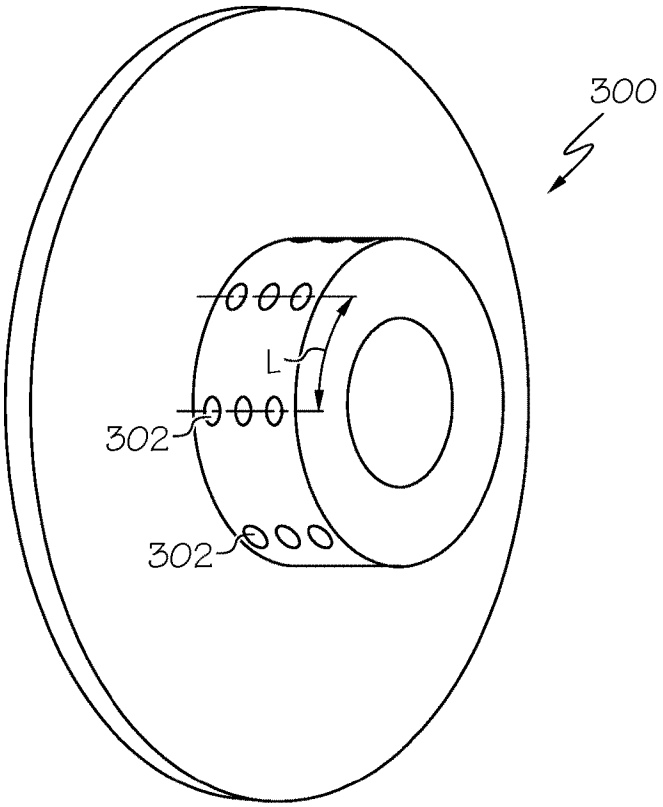
FIG. 4 shows a perspective view of a stator for use in a cavitational mixing device.

In one or more embodiments, the stator 105 can have two or more pluralities of stator bore holes. Each plurality of stator bore holes can have bore holes arranged a series or straight line. The plurality of bore holes can be spaced equally apart from one another on surface 105*b*. The distance between each plurality of stator bore holes can be in the range of 30 to 250 mm, or at least 40, 50, 60, 80, 100, 150 or 200 mm. Each plurality can have two or more bore holes, for example, 3, 4 or 5 bore holes. In one example, FIG. 4 shows a stator 300 having multiple pluralities 302 of stator bore holes arranged on the outer circumferential surface of the protuberance of the stator 300. Each plurality of bore holes on the stator 300 includes 3 stator bore holes arranged in a straight line and spaced equally from one another in a longitudinal direction along the axis of the device. It is appreciated that the stator bore holes 302 can be different shapes than as shown.

The devices described herein generally provide for introduction of a fluid into rotating bore holes 107 and stationary bore holes 104 for the formation of cavitation bubbles in the fluid as it passes through the device. A vortex also may be formed in the bore holes, 107, 104. Generally, the bore holes 107 and 104 are configured to alternate between at least two positions, for example, positions that can be described as a "closed position" and an "open position."

"Closed position" used herein refers to the rotor bore holes 107 not being in line, in register or partially in line or in register with the stator bore holes 104. That is, in a closed position, the stator bore holes 104 face outwardly towards a portion of the inner circumferential surface 108*b* of the rotor 108, wherein the portion of surface 108*b* does not include a rotor bore hole 107 or a portion thereof. Similarly, in a closed position, the rotor bore holes 107 face inwardly towards a portion of the outer circumferential surface 105*b* of the stator 105, wherein the portion of surface 105*b* does not include a stator bore hole 104 or a portion thereof.

"Open position" used herein refers to the rotor bore holes 107 being in line, in register or partially in line or in register with the stator bore holes 104. That is, in an open position, the stator bore holes 104 face outwardly towards a portion of the inner circumferential surface 108*b* of the rotor 108, wherein the portion of surface 108*b* includes a rotor bore hole 107 or a portion thereof. Similarly, in an open position, the rotor bore holes 107 face inwardly towards a portion of the outer circumferential surface 105*b* of the stator 105, wherein the portion of surface 105*b* includes a stator bore hole 104 or a portion thereof.

In the "closed position," the pressure in the rotor bore holes 107 increases and the pressure in the stator bore holes 104 decreases under the action of inertial forces caused by rotation of the components, for example, the rotor 108 relative to the stationary stator 105. Due to this changing pressure condition, the fluid in the rotor bore holes 107 compresses and thereby stores energy in the fluid. Fluid in the stator bore holes 104 decompresses and cavitation bubbles are formed therein and around the bore holes 104 in space 106.

In the "open position," rotor bore holes 107 are opened and the stored compression energy is released as a hydraulic pressure pulse. This pressure pulse can be several orders of magnitude higher than the static pressure in the fluid within the device. Elevated hydraulic pulse pressure propagates through the stator bore holes 104 positioned opposite the rotor bore holes 107 and collapses the cavitation bubbles therein. Collapse of the cavitation bubbles releases energy into the fluid in the stator bore holes 104. Elevated hydraulic pulse pressures are generally beneficial for greater energy releases from the cavitation bubbles during collapse. The power output, N, from the cavitation bubble collapse can be measured by the following equation:

$$N = 4.60R^2\sqrt{\frac{P_0^3}{\rho}},$$

where R is the maximum radius the bubble has at the beginning of collapse, $P_0$ is hydraulic pulse pressure in surrounding fluid and initiated the bubble during collapse, and ρ is the fluid density.

Although the present disclosure has applications in mixing, one skilled in the art would appreciate that the present disclosure may be utilized as a reactor to enhance and expedite chemical reactions.

It will be understood that this invention is not limited to the above-described embodiments. Those skilled in the art having the benefit of the teachings of the present invention as hereinabove set forth, can effect numerous modifications thereto. These modifications are to be construed as being encompassed with the scope of the present invention as set forth in the appended claims.

It will be apparent to those skilled in the art that many modifications, variations, substitutions, and equivalents for the features described above may be effected without departing from the spirit and scope of the invention as defined in the claims to be embraced thereby. A preferred embodiment has been described, herein. It will be further apparent to those skilled in the art that the above methods may incorporate changes and modifications without departing from the general scope of this invention. It is intended to include all such modifications and alteration in so far as they come within the scope of the appended claims or the equivalents thereof

What is claimed is:

1. A device for cavitational mixing, the device comprising:

a) a housing comprising a chamber defined by a cylindrical wall having a longitudinal axis, the chamber further partially defined by a pair of end walls;

b) a stator forming a portion of an end wall, the stator comprising a circumferential external surface facing the cylindrical wall and a first plurality of stator bore holes oriented perpendicular to the housing longitudinal axis, the first plurality of stator bore holes comprising an opening along the circumferential external surface of the stator and a closed end positioned within the stator; and c) a rotor mounted on a shaft, the rotor positioned within the housing chamber, the rotor comprising a circumferential internal surface facing the circumferential external surface of the stator, the circumferential internal surface of the rotor having a second plurality of rotor bore holes oriented perpendicular to the housing longitudinal axis, the second plurality of rotor bore holes comprising an opening along the circumferential internal surface of the rotor and a closed end positioned within the rotor, wherein the stator and the rotor are positioned such that the first plurality of stator bore holes are substantially in registration to the second plurality of rotor bore holes, and when the rotor is rotated relative to the stator each of the second plurality of rotor bore holes passes a stator bore hole of the first plurality of stator bore holes, and wherein each of the bore holes in the second plurality of rotor bore holes and each of the bore holes in the first plurality of stator bore holes has substantially the same diameter.

2. The device of claim 1, the housing further comprising at least one inlet port for introducing fluid into a space between the circumferential internal surface of the rotor and the circumferential external surface of the stator.

3. The device of claim 2, the inlet port being positioned in the center of the stator.

4. The device of claim 1, the housing further comprising at least one outlet port for discharging fluid mixed in the device.

5. The device of claim 1, the rotor bore holes and the stator bore holes having a cylindrical shape.

6. The device of claim 1, the ratio of the depth of the stator bore holes to the depth of the rotor bore holes being less than 10:1.

7. The device of claim 6, the ratio of the depth of the stator bore holes to the depth of the rotor bore holes being greater than 1:1.

8. The device of claim 1, the stator bore holes of the first plurality are arranged in a straight-line series and each stator bore hole is equally spaced apart from one another; the rotor bore holes of the second plurality are arranged in a straight-line series and each rotor bore hole is equally spaced apart from one another.

9. The device of claim 8, each plurality of stator bore holes comprising two or more stator bore holes.

10. The device of claim 8, each plurality of rotor bore holes comprising two or more rotor bore holes.

11. The device of claim 1, the stator bore hole openings being spaced apart from the rotor bore hole openings by at least 0.1 mm.

12. The device of claim 1, the stator bore holes of the first plurality having a cylindrical shape of constant diameter and the closed end of the stator bore holes of the first plurality positioned within the stator is flat.

13. The device of claim 1, the rotor bore holes of the second plurality having a cylindrical shape of constant diameter and the closed end of the rotor bore holes of the second plurality positioned within the rotor is flat.

14. The device of claim 1, the chamber having a single opening for introducing fluid into the housing and a single opening for discharging fluid from the housing.

* * * * *